US006123530A

United States Patent [19]

Nakazawa et al.

[11] Patent Number: 6,123,530

[45] Date of Patent: Sep. 26, 2000

[54] SCROLL-TYPE COMPRESSOR WITH A SLIDER PLATE FOR SMOOTHING THE ORBITING MOVEMENT OF A MOVABLE SCROLL

[75] Inventors: Kenji Nakazawa, Kariya; Yoshitaka Akiyama, Chiryu; Yuuji Yamamoto, Toyota; Yasushi Watanabe, Kariya; Izuru Shimizu, Kariya; Masao Iguchi, Kariya, all of Japan

[73] Assignees: Denso Corporation; Kabushiki Kaisha Toyoda Jidoshokki Seisakusho, both of Kariya, Japan

[21] Appl. No.: 09/059,379

[22] Filed: Apr. 14, 1998

[30] Foreign Application Priority Data

Apr. 15, 1997 [JP] Japan ..... 9-097052

[51] Int. Cl.[7] ..... F01C 1/02

[52] U.S. Cl. ..... 418/55.2; 418/55.1

[58] Field of Search ..... 418/55.1, 55.2

[56] References Cited

U.S. PATENT DOCUMENTS

| | | | |
|---|---|---|---|
| 5,173,042 | 12/1992 | Chambers | 418/55.1 |
| 5,366,359 | 11/1994 | Bookbinder et al. . | |
| 5,531,578 | 7/1996 | Takemoto et al. | 418/55.1 |
| 5,641,278 | 6/1997 | Tsumagari et al. | 418/55.1 X |

FOREIGN PATENT DOCUMENTS

| | | |
|---|---|---|
| 6-12113 | 2/1994 | Japan . |
| 2 132 276 | 7/1984 | United Kingdom . |

*Primary Examiner*—Hoang Nguyen
*Attorney, Agent, or Firm*—Pillsbury Madison & Sutro LLP

[57] ABSTRACT

A scroll-type compressor includes a front housing, a rear housing, and stationary and movable scrolls engaging with each other to define a plurality of compression chambers therebetween. The stationary scroll is connected to the rear housing to define a discharge chamber therebetween. The stationary and movable scrolls are provided between the front and rear housings so that the movable scroll moves along an orbiting path. A drive shaft extends through the front housing and is drivingly connected to the movable scroll. The rotation of the drive shaft moves the movable scroll along the orbiting path to shift the compression chambers from the periphery to the center of the scrolls with the volume of the chambers reducing. A slider plate, substantially in the form of a ring, for providing a sliding surface for the movable scroll, relative to the front housing, is disposed between the front housing and the movable scroll. The slider plate includes first and second slots which are disposed diametrically opposite to each other and extend radially and circumferentially, respectively. A pair of pins are provided for engagement with the first and second slots of the slider plate to lock and secure the slider plate to the front housing or to the movable scroll.

15 Claims, 5 Drawing Sheets

SCROLL-TYPE COMPRESSOR WITH A SLIDER PLATE FOR SMOOTHING THE ORBITING MOVEMENT OF A MOVABLE SCROLL

BACKGROUND OF THE INVENTION

1. Field of the Invention

The invention relates to a scroll-type compressor improved to smooth the orbiting movement of a movable scroll.

2. Description of the Related Art

A scroll-type compressor generally comprises movable and stationary scrolls. The movable scroll includes a movable end wall and a movable spiral member which are connected to each other. The stationary scroll includes a stationary end wall and a stationary spiral member which are connected to each other. The movable and stationary scrolls engage with each other to define compression chambers therebetween. The movable scroll is held by front and rear housings to move along an orbiting path. The orbiting movement of the movable scroll shifts the compression chambers from the periphery to the center of the movable and stationary scrolls to reduce the volume of the respective compression chambers.

In some scroll-type compressors a slider plate, for smoothing the orbiting movement of the movable scroll, is provided between the front housing and the movable end wall of the movable scroll.

A scroll-type compressor described in Japanese Unexamined Patent Publication (Kokai) No. 6-121113 has fixed and movable slider plates which are provided between an inner end face of a front housing and a movable end wall of a movable scroll through an arrangement for preventing the movable scroll from rotating about its axis. The arrangement for preventing the movable scroll from rotating about its axis comprises a fixed ring with one or more recesses disposed along the periphery thereof, a movable ring with one or more recesses disposed along the periphery thereof, and ball elements inserted into each of the recesses of the fixed and movable rings. A fixed race is provided between the inner end face of the front housing and the fixed ring, which is secured to the front housing by means of a spring pin and caulking along the fixed ring. A movable race is provided between the movable end wall and the movable ring, which is fixed to the movable end wall by means of spring pins and caulking along the movable ring.

The method of providing a slider plate described in the publication, however, inherently involves a problem that manufacturing cost is increased since the slider plates are secured by caulking, which increases the stages of the manufacturing process of a scroll-type compressor. In addition to this, the slider plate secured by means of caulking cannot be replaced at the end of its life because it is connected to the front housing by caulking, which results in the replacement of all of the associated components.

On the other hand, connection by only the spring pins is insufficient to secure the slider plates since the spring pins are elastic members, and they may easily become loose against the associated elements such as the slider plates or the inner end face of the front housing, due to the compression load and vibration, etc., during operation of the compressor. Such loosening between the spring pins and the slider plates may result in the noise and friction which often appear in a compressor with a slider plate which is not secured so that the plate rotates with a movable scroll.

Further, when the spring pins are loosened to fall off the front housing, they obstruct the operation of the compressor.

SUMMARY OF THE INVENTION

The invention is directed to solve the above mentioned prior art problems and the objective of the invention is to provide a scroll-type compressor improved to enable replacement of a slider plate, for providing a sliding surface between the front housing and the movable scroll, easily and to reduce the production cost of the compressor.

According to the invention, a scroll-type compressor comprises a front housing having an axially inner end face; a rear housing; a stationary scroll including a stationary end wall and a stationary spiral member connected to each other, the stationary end wall being connected to the rear housing to define a discharge chamber therebetween, the stationary spiral member being connected to the front housing; a movable scroll including a movable end wall and movable spiral member connected to each other, the movable scroll being provided between the stationary scroll and the front housing to move along an orbiting path relative to the front housing and the stationary scroll, the movable and stationary scrolls engage with each other to define a plurality of compression chambers therebetween; a drive shaft drivingly connected to the movable scroll, the drive shaft being supported by the front housing for rotation, the rotation of the drive shaft moving the movable scroll along the orbiting path to shift the compression chambers from the periphery to the center of the scrolls with the volume of the chambers reducing; a slider plate substantially in the form of a ring, for providing a sliding surface for the movable scroll relative to the front housing, the slider plate being disposed between the front housing and the movable scroll, the slider plate including first and second slots which are disposed diametrically opposite to each other and extend radially and circumferentially; a pair of pins are provided for engagement with the first and second slots of the slider plate to lock and secure the slider plate to the front housing or to the movable scroll.

The pair of pins are secured to the inner end face of the front housing to extend from the end face toward the movable scroll, or to the end wall of the movable scroll to extend toward the front housing.

The invention simplifies the assembly of the scroll-type compressor since the slider plate can be secured only by the pins being pressed to fit into the slots without caulking. This reduces the number of stages in the manufacturing process and the cost. The slider plate can be replaced with a new one at the end of the life of the slider plate by pulling off the slider plate from the pins which are left on the front housing or the movable scroll. A new slider plate for replacement can be secured by pressing it to fit onto the pins, thus the replacement of a slider plate alone is possible.

Further, the pins can firmly secure the slider plate and the front housing or a movable scroll since the pins are solid and do not allow looseness between the pins, the slider plate and the front housing or the movable end wall in spite of the vibration during operation of the compressor. Therefore, the slider plate is held tightly, and no noise and friction can occur. Also, since the pins do not fall off the front housing or the movable end wall, they do not obstruct the operation of the compressor.

In this way, this method realizes reduction of the manufacturing cost, a replacement of the slider plate alone, and the prevention of noise and friction.

DESCRIPTION OF THE DRAWINGS

These and other objects and advantages and further description will now be discussed in connection with the drawings in which.

DESCRIPTION OF THE PREFERRED EMBODIMENTS

Figure 1:
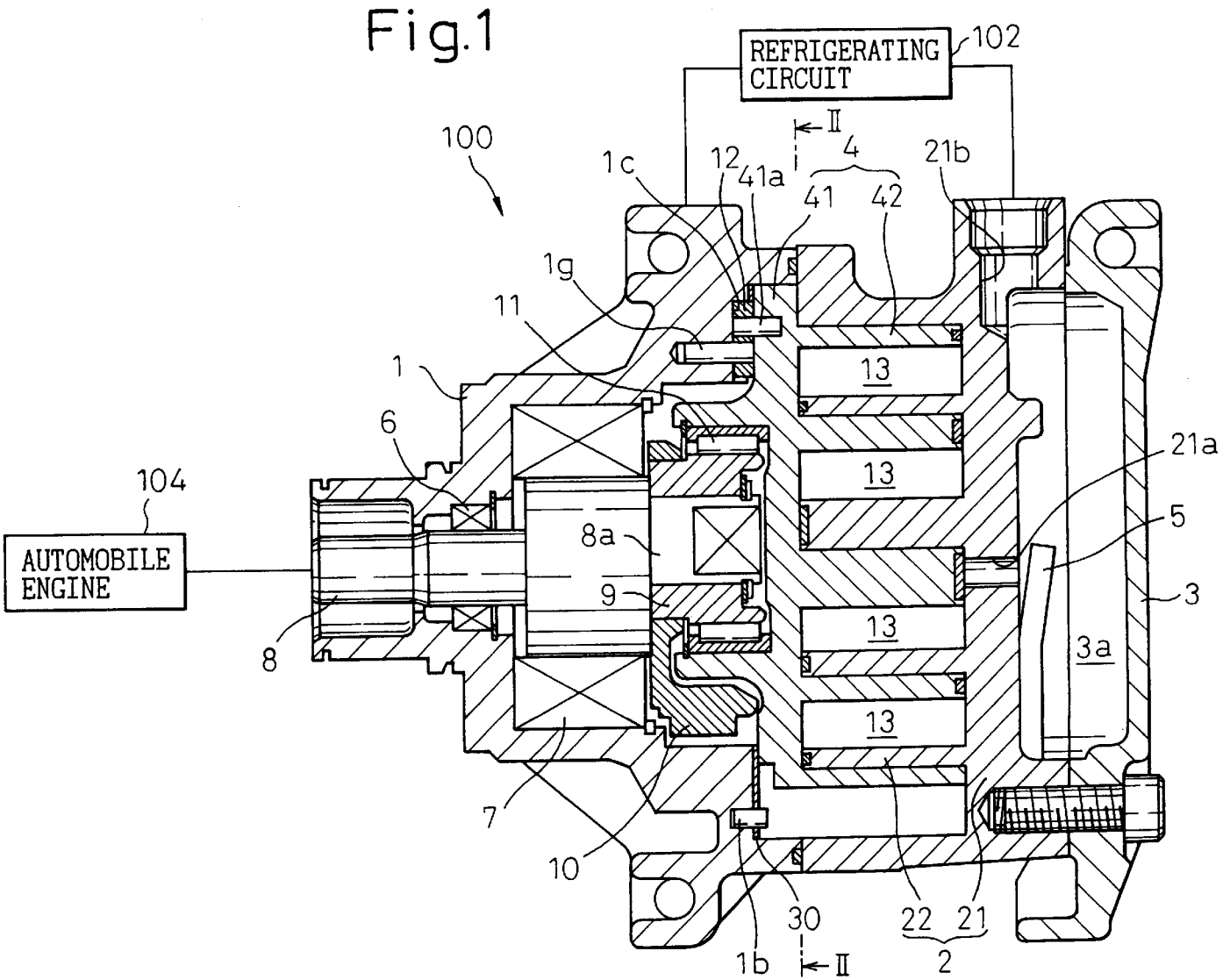
FIG. 1 is a longitudinal section of a scroll-type compressor according to the embodiment of the invention.

With reference to FIGS. 1–6, a first embodiment of the invention will be described hereinafter.

A scroll-type compressor 100 according to the first embodiment of the invention comprises front and rear housings 1 and 3 between which movable and stationary scroll members 4 and 2 are provided to engage with each other. The movable and stationary scrolls 4 and 2 engaging with each other define a plurality of compression chambers 13. The front housing 1 rotatably supports a drive shaft 8 for driving the movable scroll 4 via a seal 6 and a boaring 7. The drive shaft 8 includes a slide key 8*a* which is eccentrically provided on the inner end face of the drive shaft 8, and a drive bush 9 which engages the slide key 8*a*. A counterweight 10 is secured to the front side of the drive bush 9.

The drive shaft 8 is operatively connected to a rotational power source, such as an automobile engine 104 by an appropriate transmission device which may include a pulley, V-belts and a electromagnetic clutch.

The movable scroll 4 includes a movable end wall 41 and a movable spiral member 42 in the form of a spirally extending wall which may be made of aluminum alloy. The stationary scroll 2 may also made of aluminum alloy and includes a stationary end wall 21 which is sealingly attached to the rear housing 3 by bolts 3*b* to define a discharge chamber 3*a* therebetween, and a stationary spiral member 22 in the form of a spirally extending wall which is sealingly connected to the front housing 1 by a plurality of bolts (not shown).

The movable scroll 4 is provided between the front housing 1 and the stationary scroll 2 and is connected to the drive bush 9 so that the rotation of the drive shaft 8 moves the movable scroll 4 along a predetermined orbiting path around the longitudinal axis of the compressor 100. A slider plate 30, in the form of a ring of ferric alloy, for providing a sliding surface between the front housing 1 and the movable scroll 4 is disposed between the front housing 1 and the movable scroll 4 to smooth the orbiting movement of the movable scroll 4.

The orbiting movement of the movable scroll 4 causes gradual shifting of the compression chambers 13 from the periphery to the center of the scrolls 4 and 2. During the shifting of each of the compression chambers 13, the volume thereof is gradually reduced. The pressure in the respective compression chambers 13 gradually increases.

The stationary scroll 2 includes a discharge passage 21*a* through the center of the end wall 21 to fluidly connect the compression chamber 13 which has moved to the center of the scrolls 2 and 4 to the discharge chamber 3*a*. FIG. 1 shows the compressor 1 in which the movable scroll 4 is displaced at an orbiting position where a compression chamber 13 is not at the center of the scrolls 4 and 2. A valve retainer 5 for a valve 5*a* is provided in the discharge chamber 3*a*.

Figure 2:
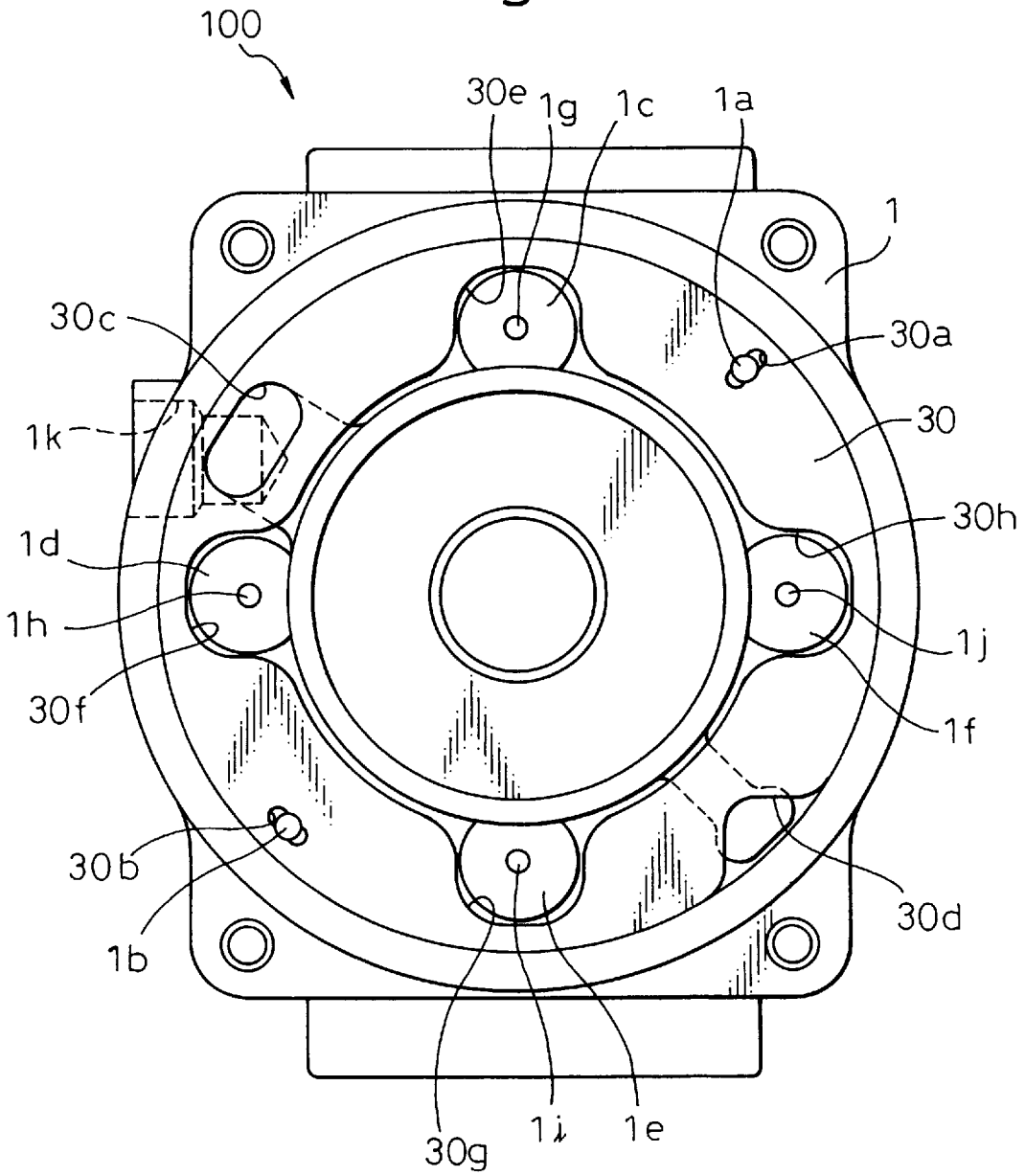
FIG. 2 is an elevation of the inner end face of the font housing and a slider plate of the invention attached to the end face.

The discharge chamber 3*a* is fluidly connected to an outside refrigerating circuit 102 through a discharge port 21*b* formed in the end wall 21 of the stationary scroll 2. The discharge port 21*b* may be defined in the rear housing 3. The lower pressure side of the refrigerating circuit 102 is fluidly connected to the compressor 100 through a suction port 1*k* which is defined in the front housing 1 (FIG. 2).

The inner end face of the front housing 1 defines recesses 1*c* to 1*f* which are equally disposed around the longitudinal axis of the front housing 1. Stationary pins 1*g* to 1*j* are fixed to the front housing 1 at the centers of the recesses 1*c* to 1*f*, respectively. The stationary pins 1*g* to 1*j* support retainers 12 (only one of them is shown in FIG. 1) for rotation within the recesses about the pins 1*g* to 1*j*. Four movable pins 41*a* (only one of them is shown) are connected to the movable scroll 4 to extend toward the inner end face of the front housing 1. The movable pins 4*a* are also connected to the retainers 12. The stationary pins 1*g* to 1*j*, the pins 41*a* and the retainers 12 constitute an arrangement for preventing the movable scroll from rotating about its axis.

Figure 3:
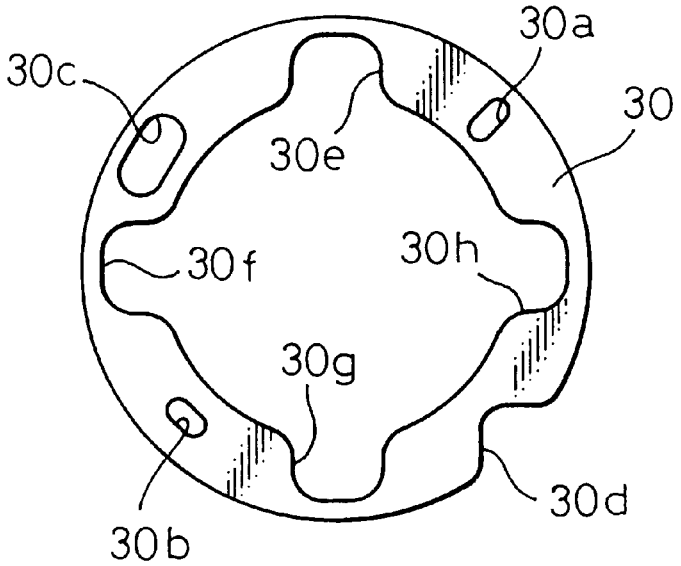
FIG. 3 is a plain view of the slider plate of the embodiment according to the invention.
Figure 4:
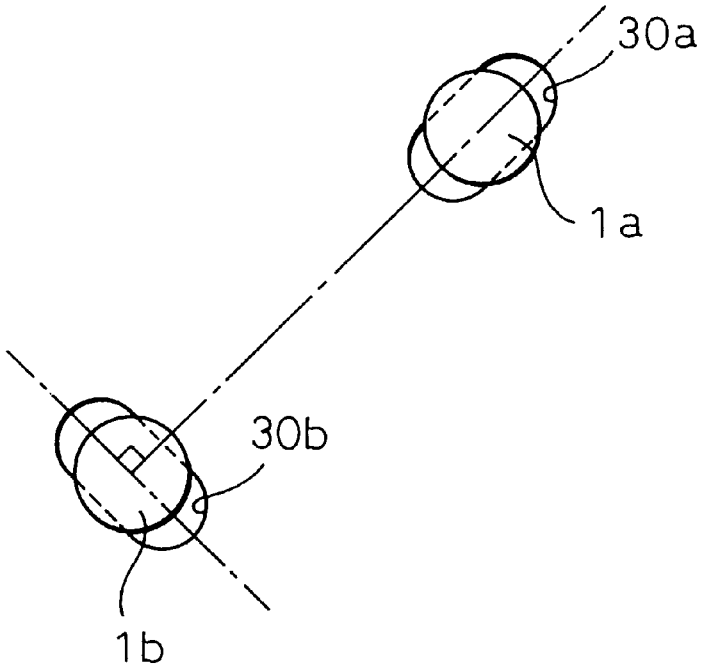
FIG. 4 is a schematic illustration of first and second slots provided in the slider plate shown in FIG. 3 for explaining the orientation of the slots.

With reference to FIGS. 3 and 4, the slider plate 30 is provided with first and second slots 30*a* and 30*b*. In the preferred embodiment shown in FIGS. 3 and 4, the first and second slots 30*a* and 30*b* are disposed advantageously diametrically opposite to each other. In particular, the first slot 30*a* is provided so that it is directed toward the center of the axis, while the second slot 30*b* is provided perpendicular to the first slot 30*a*.

The slider plate 30 is further provided with an aperture 30*c* and a notch 30*d* which is formed in the outer periphery of the slider plate 30. The aperture 30*c* and the notch 30*d* provide a suction passage between the suction port 1K in the front housing 1 and the outermost compression chamber 13. In the inner periphery of the slider plate 30, recesses 30*e* to 30*h* are provided to prevent the rotation of the slider plate 30 about its axis.

Two pins 1*a* and 1*b* of ferric alloy which have a circular section are pressed to fit into bores (not shown) provided in the inner end face of the front housing 1 so that they extend from the end face toward the movable scroll 4. The pins 1*a* and 1*b* are disposed diametrically opposite to each other. The slider plate 30 is secured to the housing 1 by the pins 1*a* and 1*b*pressed to fit into the slots 30*a* and 30*b* in the slider plate 30, respectively, as illustrated in FIGS. 2 and 4.

The arrangement of the pins 1*a* and 1*b* may include errors in dimensions and positioning. According to the invention, the error in the diametrical distance between the pins 1*a* and 1*b* can be compensated for by the first slot 30*a* which is oriented in the radial direction, and the directional error between the pins 1*a* and 1*b* can be compensated by the second slot 30*b* which is oriented in the circumferential direction.

The possible fluctuation in the fitting interference between the slots and the pins does not substantially change the load to the plate 30 for the fitting of the pins 1*a* and 1*b*, from production to production, since the plate 30 is secured by only the pins 1*a* and 1*b* fitted into the first and second slots 30*a* and 30*b*. Thus, the slider plate 30 does not deform in the axial direction around the slots 30*a* and 30*b*. Therefore, the arrangement of pins 1*a* and 1*b* and the slots 30*a* and 30*b* for securing the plate 30 does not deteriorate the ability of the movable end wall 41 to slide relative to the front housing.

Further, the possible errors in the longitudinal dimensions of the housings 1 and 3 and scrolls 4 and 2 can be compensated for by preparing various slider plates 30 of different thickness and by selecting the one which can cancel the error.

In the scroll-type compressor 100, the pins 1*a* and 1*b* firmly secure the slider plate 30 to the front housing 1 since the pins are solid and do not allow loosening between the pins, the slider plate 30 and the front housing 1 due to the vibration during operation of the compressor 100. Therefore, the slider plate 30 is held tight, and no noise and friction occur. Also, as the pins 1*a* and 1*b* do not fall off the front housing 1, they cannot obstruct the operation of the compressor.

Thus, according to the scroll-type compressor, the number of stages in production process and the production cost can be reduced since the slider plate 30 can be secured to the front housing 1 without caulking.

Refrigerant gas is introduced into the compression chambers 13 through the suction port 1*k* and the suction passages 30*c* and 30*d* from the refrigerating circuit 102. The rotation of the drive shaft 8 moves the movable scroll 4 along a predetermined orbiting path around the longitudinal axis of the compressor 100. The orbiting movement of the movable scroll 4 causes gradual shifting of the compression chambers 13 from the periphery to the center of the scrolls 4 and 2. During the shifting of each of the compression chambers 13, the volume thereof is gradually reduced to increase the pressure of the refrigerant gas in the respective compression chambers 13. When one of the compression chambers 13 moves to the center of the scrolls 4 and 2, the compressed refrigerant gas is discharge to the discharge chamber 3*a* through the discharge passage 21*a*, from which the refrigerant gas will be further discharged to the refrigerating circuit 102 through the discharge port 21*b*.

During the operation of the compressor, the slider plate 30 smoothes the sliding between the front housing 1 and movable end wall 41 of the movable scroll 4. The slider plate 30 is firmly secured to the front housing 1 and is not displaced by a radial force on the slider plate 30 since the longitudinal axes of the slots 30*a* and 30*b* are oriented perpendicular to each other.

When the slider plate 30 must be replaced with a new one due to the end of its life, the slider plate 30 only can be simply removed from the pins 1*a* and 1*b* without a substantial change in the condition of the pins 1*a* and 1*b*. A new slider plate for replacement can be attached by pressing the original pins 1*a* and 1*b* to fit into the slots 30*a* and 30*b* in the new slider plate 30. Thus, according to the invention, the slider plate 30 only can be replaced while in a compressor according to the prior art a front housing must be replaced with a slider plate attached thereto by caulking.

According to the invention, noise and friction can be reduced, the manufacturing cost can be lowered, and replacement of only the slider plate 30 is possible.

Figure 7:
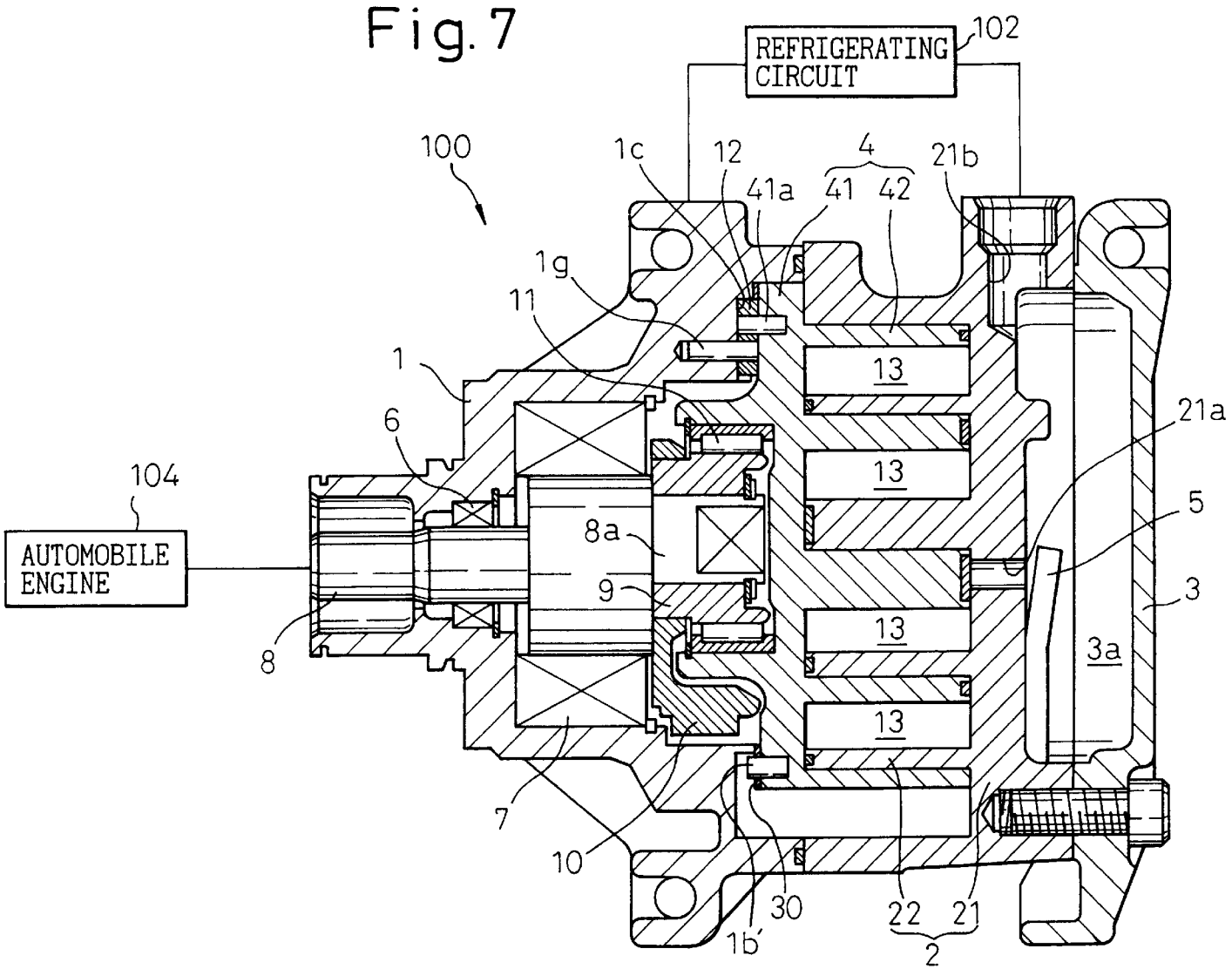
FIG. 7 is a longitudinal section, similar to FIG. 1, of a variant embodiment.

As described above, the plate 30 is secured to the inner end face of the front housing 1. With reference to FIG. 7, in a variant embodiment, a plate 30' for providing a sliding surface between the front housing 1 and the movable scroll 4 is secured to the end face of the end wall 41 of the scroll 4 by two pins 1*b*', only one of which is shown in FIG. 7, to smooth the orbiting movement of the movable scroll 4. The rest of the configuration of the compressor is substantially the same as the preceding embodiment.

In order to make clear the advantage of the invention, comparative examples shown in FIGS. 5 and 6 will be described.

Figure 5:
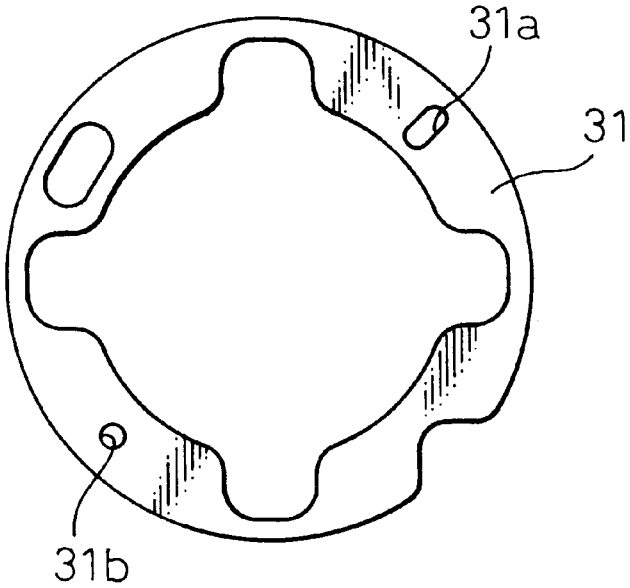
FIG. 5 is a plan view of a slider plate of a comparative example.

FIG. 5 shows a slider plate 31 according to a first comparative example. The slider plate 31 is provided with a slot 31*a* and a circular aperture 31*b* which are disposed diametrically opposite to each other. The slot 31*a* is oriented to the center. The other configuration is identical to that of the embodiment described above.

The slider plate 31 can cancel the error in the radial distance between the pins 1*a* and 1*b*. However, the pressing load for fitting the pins 1*a* and 1*b* into the circular aperture 31*b* is higher than that for fitting the pin into the slot 31*a*, which causes an inclination of the slider plate 31 relative to the end face of the housing 1, which makes the assembly of the compressor difficult.

Also, as all of the circumference of the circular aperture 31*b* is pressed to fit to the pin 1*b*, the slider plate 31 may easily deform in the axial direction along the periphery of the circular aperture 31*b* due to an error in the fitting interference. This impairs the sliding of the movable end wall 41 on the slider plate 31, and the assembly of the components.

Figure 6:
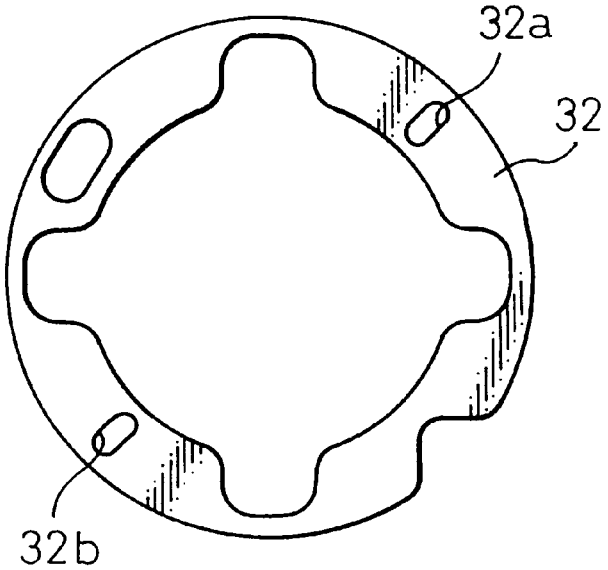
FIG. 6 is a plan view of a slider plate of another comparative example.

FIG. 6 shows a second comparative example. A slider plate 32 is provided with slots 32*a* and 32*b* disposed diametrically opposite to each other. The slots 32*a* and 32*b* are formed to be oriented in the same direction. The rest of the configuration is identical to that of the above-described embodiment of the invention.

When the slider plate 32 is attached to the inner end face of the housing 1, and error in the radial dimension between the pins 1*a* and 1*b* can be compensated for by the slots 32*a* and 32*b*. However, the slider plate 32 may move in the direction of the slots 32*a* and 32*b* due to the radial load applied to the slider plate 32.

Thus, the configuration of the slots 30*a* and 30*b* in the slider plate 30 of the invention, that is, one extends radially and the other extends circumferentially, is advantageous.

A variation can be considered where two solid pins which have circle section are connected to a slider plate 30 to extend axially to the front housing 1. The pins are pressed to fit into slots, similar to the slots 30*a* and 30*b*, which may be provided in the inner end face of the front housing 1 or in the end face of the movable end wall 41. In this case, however, an error in the axial dimensions of the housings and the scrolls will not be compensated for since preparation of various slider plates which have different thickness is difficult.

In the embodiment described above, the slider plate 30 includes the first and second slots 30*a* and 30*b* which are oriented perpendicular to each other and disposed diametrically opposite to each other. However, the present invention is not limited to this configuration. The first and second slots 30*a* and 30*b* can be arranged so that they are oriented in directions, including the radial and circumferential components, respectively, different from each other, beyond the above-described perpendicular configuration of the slots. The radial component of the direction compensates for the error in the radial distance between the pins 30*a* and 30*b* while the circumferential component of the direction restrains the radial movement of the slide plate 30. Further, the first and second slots 30*a* and 30*b* are not necessarily disposed diametrically opposite to each other. In this case, the first slots 30*a* are oriented toward the second slots 30*b*.

It will also be understood by those skilled in the art that the forgoing description is a preferred embodiment of the disclosed device and that various changes and modifications may be made without departing from the spirit and scope of the invention.

We claim:

1. A scroll-type compressor comprising:

a front housing having an axially inner end face and a central bore extending along the axis of the front housing;

a rear housing;

a stationary scroll including a stationary end wall and a stationary spiral member connected to each other, the stationary scroll being connected to the rear housing to define a discharge chamber therebetween;

a movable scroll including a movable end wall and a movable spiral member connected to each other, the movable scroll being provided between the stationary scroll and the front housing to move along an orbiting path relative to the front housing and the stationary scroll, the movable and stationary scrolls engage with each other to define a plurality of compression chambers therebetween;

a drive shaft drivingly connected to the movable scroll, the drive shaft being supported by the front housing for rotation, the rotation of the drive shaft moving the movable scroll along the orbiting path to shift the compression chambers from the periphery to the center of the scrolls with the volume of the chambers reducing;

a slider plate substantially in the form of a ring, for providing a sliding surface for the movable scroll relative to the front housing, the slider plate being disposed between the front housing and the movable scroll, the slider plate including first and second slots which extend in different directions from each other; and pins provided for engagement with the first and second slots of the slider plate to lock and secure the slider plate to the front housing or to the movable scroll.

2. A scroll-type compressor according to claim 1 in which the first and second slots extend radially and circumferentially, respectively.

3. A scroll-type compressor according to claim 1 in which the first and second slots extend in directions which include radial and circumferential components, respectively.

4. A scroll-type compressor according to claim 1 in which the first and second slots extend perpendicularly to each other.

5. A scroll-type compressor according to claim 1 in which the pins are disposed diametrically opposite to each other around the axis of the compressor.

6. A scroll-type compressor according to claim 1 in which the pins are secured to the inner end face of the front housing to extend from the end face toward the movable scroll.

7. A scroll-type compressor according to claim 6, further comprising means for preventing the movable scroll from rotating about the axis of the movable scroll and for allowing the movable scroll to move along the orbiting path.

8. A scroll-type compressor according to claim 7, in which the means includes a recessed seat substantially in the form of a circle which is provided in the inner end face of the front housing;

a retainer substantially in the form of a circular plate which is received in the recessed seat;

a stationary pin, disposed at the center of the recess, for connecting the retainer to the front housing for rotation about the stationary pin; and a movable pin which is connected to the movable end wall of the movable scroll to be eccentrically disposed relative to the stationary pin and is connected to the retainer to move along an orbiting path about the stationary pin whereby the orbiting movement of the movable pin results in the orbiting movement of the movable scroll.

9. A scroll-type compressor according to claim 8 in which the slider plate includes a radially outwardly recessed portion provided at the inner periphery of the plate, the recessed portion being disposed corresponding to the disposition of the recessed seat for the retainer.

10. A scroll-type compressor according to claim 9, in which the rear housing includes a outlet port for fluidly connecting the discharge chamber to an outside refrigerating circuit;

the front housing including an inlet port fluidly connected to the refrigerating circuit; and the sliding plate including an opening for providing a suction passage between the inlet port and the outermost compression chamber of the compressor.

11. A scroll-type compressor according to claim 1 in which the pins are secured to the movable end wall of the movable scroll to extend from the movable end wall toward the inner end face of the front housing.

12. A scroll-type compressor according to claim 11, further comprising means for preventing the movable scroll from rotating about the axis of the movable scroll and for allowing the movable scroll to move along the orbiting path.

13. A scroll-type compressor according to claim 12, in which the means includes a recessed seat substantially in the form of a circle which is provided in the inner end face of the front housing;

a retainer substantially in the form of a circular plate which is received in the recessed seat;

a stationary pin, disposed at the center of the recess, for connecting the retainer to the front housing for rotation about the stationary pin; and a movable pin which is connected to the movable end wall of the movable scroll to be eccentrically disposed relative to the stationary pin, and is connected to the retainer to move along an orbiting path about the stationary pin whereby the orbiting movement of the movable pin results in the orbiting movement of the movable scroll.

14. A scroll-type compressor according to claim 13 in which the slider plate includes a radially outwardly recessed portion provided at the inner periphery of the plate, the recessed portion being disposed corresponding to the disposition of the recessed seat for the retainer.

15. A scroll-type compressor according to claim 14, in which the rear housing includes a outlet port for fluidly connecting the discharge chamber to an outside refrigerating circuit;

the front housing including an inlet port fluidly connected to the refrigerating circuit; and the sliding plate including an opening for providing a suction passage between the inlet port and the outermost compression chamber of the compressor.

* * * * *